United States Patent [19]

Rose et al.

[11] Patent Number: 4,907,839

[45] Date of Patent: Mar. 13, 1990

[54] WALKER WITH FOLDING SEAT

[75] Inventors: Eric P. Rose, Canoga Park; Christopher R. Reed, Lakeview Terrace, both of Calif.

[73] Assignee: Guardian Products, Inc., Arleta, Calif.

[21] Appl. No.: 307,697

[22] Filed: Feb. 7, 1989

Related U.S. Application Data

[63] Continuation-in-part of Ser. No. 255,998, Oct. 10, 1988.

[51] Int. Cl.[4] ..... A61H 3/04

[52] U.S. Cl. ..... 297/6; 135/67; 297/334

[58] Field of Search ..... 297/5, 6, 14, 146, 191, 297/331, 334, 335; 108/40; 135/67

[56] References Cited

U.S. PATENT DOCUMENTS

| | | | |
|---|---|---|---|
| 1,498,319 | 6/1924 | Dexter | 108/40 |
| 1,917,440 | 7/1933 | Finkbeiner, et al. . | |
| 2,369,040 | 2/1945 | Grady | 297/6 X |
| 2,374,182 | 4/1945 | Duke | 297/6 |
| 2,450,051 | 9/1948 | Manning . | |
| 2,960,148 | 11/1960 | Murcott . | |
| 2,996,070 | 8/1961 | Ries . | |
| 3,098,651 | 7/1963 | Murcott . | |
| 3,194,577 | 7/1965 | Berlin . | |
| 3,350,095 | 10/1967 | Clasen . | |
| 3,354,893 | 11/1967 | Schmerl . | |
| 3,397,883 | 8/1968 | Kiehn . | |
| 3,398,974 | 8/1968 | Edwards, et al. . | |
| 3,778,052 | 12/1973 | Andow, et al. . | |
| 3,872,945 | 3/1975 | Hickman . | |
| 3,945,389 | 3/1976 | Smith . | |
| 3,999,228 | 12/1976 | Thomas . | |
| 4,018,440 | 4/1977 | Deutsch . | |
| 4,046,374 | 9/1977 | Breyley . | |
| 4,086,932 | 5/1978 | Richardson . | |
| 4,094,330 | 6/1978 | Jong . | |
| 4,159,110 | 1/1979 | Dodenhoff . | |
| 4,164,354 | 2/1980 | Rodaway . | |
| 4,187,869 | 2/1980 | Marchette . | |
| 4,188,966 | 2/1980 | Palmer . | |
| 4,211,426 | 7/1980 | Motloch . | |
| 4,211,309 | 7/1980 | Ruggiero . | |
| 4,251,044 | 2/1981 | Olson . | |
| 4,251,105 | 2/1981 | Barker . | |
| 4,253,678 | 3/1981 | Leclerc . | |
| 4,254,948 | 3/1981 | Jacobs . | |
| 4,261,804 | 11/1986 | Mueller | |
| 4,272,071 | 6/1981 | Bolton . | |
| 4,277,100 | 7/1981 | Beougher | 135/67 X |
| 4,289,156 | 9/1981 | Ulics . | |
| 4,332,378 | 6/1982 | Pryor . | |
| 4,341,381 | 7/1982 | Norberg . | |
| 4,342,465 | 8/1982 | Stillings . | |
| 4,384,713 | 5/1983 | Deutsch . | |
| 4,387,891 | 6/1983 | Knochel . | |
| 4,461,471 | 7/1984 | Brastow . | |
| 4,510,956 | 4/1985 | King . | |
| 4,643,211 | 2/1987 | Morris et al. | 297/6 X |

FOREIGN PATENT DOCUMENTS

| | | | |
|---|---|---|---|
| 1465277 | 2/1977 | United Kingdom | 135/67 |

OTHER PUBLICATIONS

The Rollator Kombi advertisement discloses a rolling walker having adjustable height handles and brakes.

The Uniscan advertisement discloses rolling walkers which fold and provide automatically-locking brake action.

The DMA advertisement discloses lightweight, foldable push chairs.

The Wheel-A-Walk advertisement discloses a rolling walker with adjustable height handles and braking action.

The American Walker Walk-A-Cycles advertisement discloses rolling walkers having adjustable handles and brakes.

The Odatt Medical Products, Inc. advertisement discloses rolling walkers having a seat which can be raised and lowered.

*Primary Examiner*—Peter R. Brown

*Attorney, Agent, or Firm*—Christie, Parker & Hale

[57] ABSTRACT

A walker with a retrofittable foldable sheet has at least one front leg and a plurality of rear legs. Clamps attach to each of the legs and a seat extends over and is supported by the clamps. A guide connects a portion of the seat to at least one of the front legs to allow the seat to be moved from an in-use position to a storage position against the front legs. The seat has a receptacle for each clamp when positioned for use and a receptacle for each front clamp and for the guide when in storage. Clips are used to hold the walker against the front legs of the walker.

31 Claims, 10 Drawing Sheets

WALKER WITH FOLDING SEAT

CROSS-REFERENCE TO RELATED APPLICATIONS

This application is a continuation-in-part of U.S. patent application Ser. No. 255,998, filed Oct. 10, 1988 entitled "Walker With Removable Seat," the disclosure of which is incorporated herein by reference.

Field of the Invention

This invention pertains to the field of walkers for invalids and in particular to walkers having a folding seat. Background of the Invention As the life expectancy of the general population increases, so does the need for a wide variety of special products, particularly durable medical equipment such as walkers for invalids and for those who need greater assistance in walking than is provided by hand-held canes and the like.

A wide variety of walking aids have already been developed, including walking aids for invalids and other disabled persons such as shown in U.S. Pat. No. 4,251,105 to Barker which describes a typical rigid walker. U.S. Pat. No. 3,945,389 to Smith describes a state-of-the-art walker that is collapsible or foldable.

Equipping a walker with a removable seat greatly increases the utility of the device, for it provides a temporary "resting place" for the user. An example of a walker having means for supporting a seated person is shown in U.S. Pat. No. 4,532,948 to Burrows. The seat described therein is nonremovable and is comprised of a flexible material forming a sling. Such a walker has several disadvantages; for example, a sling seat poses a serious hazard to a user because of its tendency to tear after a period of use. The weight of the user also tends to cause the mounting elements of the seat to pull away from the points of attachment on the framework of the walker particularly when attached to the side braces of a walker. The nearly horizontal side braces are not designed to take downward loading and therefore are inadequate to support the weight of a user. Additionally, whether the flexible seat is attached to the side braces or to the vertical legs of the walker, use of a flexible seat may tend to cause the folding mechanism to unlock, resulting in collapse of the walker.

U.S. Pat. No. 4,643,211 to Morris et al. describes a foldable walker having a pivotal seat that may be pivoted up out of the way of the user's legs when he or she walks with the walker. This increases the value of the walker for those who cannot travel great distances without resting but the arrangement of the seat support in Morris make the walker difficult to walk with.

Accordingly, a need exists for an improved walker with a structurally rigid, yet readily foldable seat. The present invention responds to this need. The invention also provides a convenient means for retrofitting older walkers that presently lack a seat, with a sturdy, foldable seat.

SUMMARY OF THE INVENTION

The present invention provides a walker with a foldable seat which can be conveniently moved from a deployed horizontal position resting upon supports to a stored vertical position in contact with the front legs of the walker so as to not obstruct operation of the walker by the user. Existing walkers without seats can easily be retrofitted with a foldable seat according to the present invention.

In the present invention, the walker has a pair of front legs and a pair of rear legs. A seat support is clamped to each of the legs and, each seat support has an integrally formed lobe extending from the surface of seat support into the interior of the space enclosed by the walker. A plurality of recesses are formed in the underside of the seat adjacent the corners thereof and each recess registers with and is adapted to receive one of the lobes to support the seat in the horizontal deployed position. A slotted guide bracket interconnects the seat and the front legs so that the seat may be moved from an in-use (deployed) position supported by the lobes to a vertical storage position against the front legs. The invention is adaptable to both rigid walkers and walkers which can be folded up for compactness and easy storage.

In the presently preferred embodiment the guide bracket comprises an elongated flat blade having an internal longitudinally extending slot. The guide bracket is pivotally connected to the seat support on each front leg at one end by means of a pin, and is pivotally connected at its opposite end to the seat by means of a second pin which passes through the slot in each guide and is secured to the seat adjacent the front corners thereof so that each guide bracket is slidable along its corresponding seat pin.

Additional recesses are provided in the underside of the seat for receiving the lobes of the front leg supports when the seat is in the storage position. A channel is also countersunk into the underside of the seat parallel to the side edges thereof and extending from the corner recess for receiving the guide brackets when the seat is in the storage position. Retaining means such as clips are also provided on the underside of the seat for clipping and holding the seat against the front legs. The seat is rigid and in one embodiment includes a central opening therein to permit the walker to be uses as a commode.

The present invention also provides a stowable seat for use with a walker having at least one front leg and least two rear legs. A support clamp having an integrally formed lobe is secured to each of the plurality of the legs of the walker at the desired seat height. A plurality of recesses are provided in the underside of the seat, each recess being located adjacent the edge of the seat and adapted to engage a lobe for supporting the seat when lowered into position onto each lobe. At least one slotted bracket pivotally and slidably connects the seat and the front leg so that the seat may be moved from a seating position supported by the lobes to a storage position against the front leg.

In another embodiment the invention comprises a kit for retrofitting a walker with a foldable seat. The kit comprises a combination of a rigid seat for supporting the person, a plurality of specially shaped clamps adapted to be secured to the legs of the walker for supporting the seat and a guide bracket adapted to pivotally and slidably connect the seat to a front portion of the walker to permit the seat to be moved from an in-use seating position supported by extensions formed into the clamps to a storage position folded against the front portion of the walker.

DETAILED DESCRIPTION

Figure 1A:
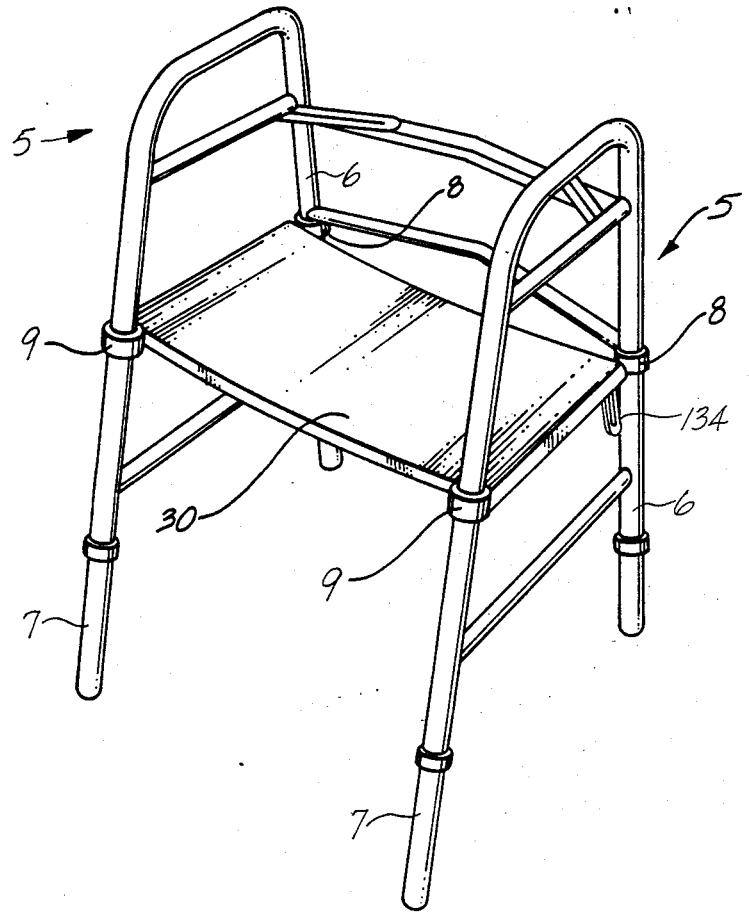
FIG. 1A is a perspective view of a walker with a seat in a horizontal deployed position according to the present invention.
Figure 1B:
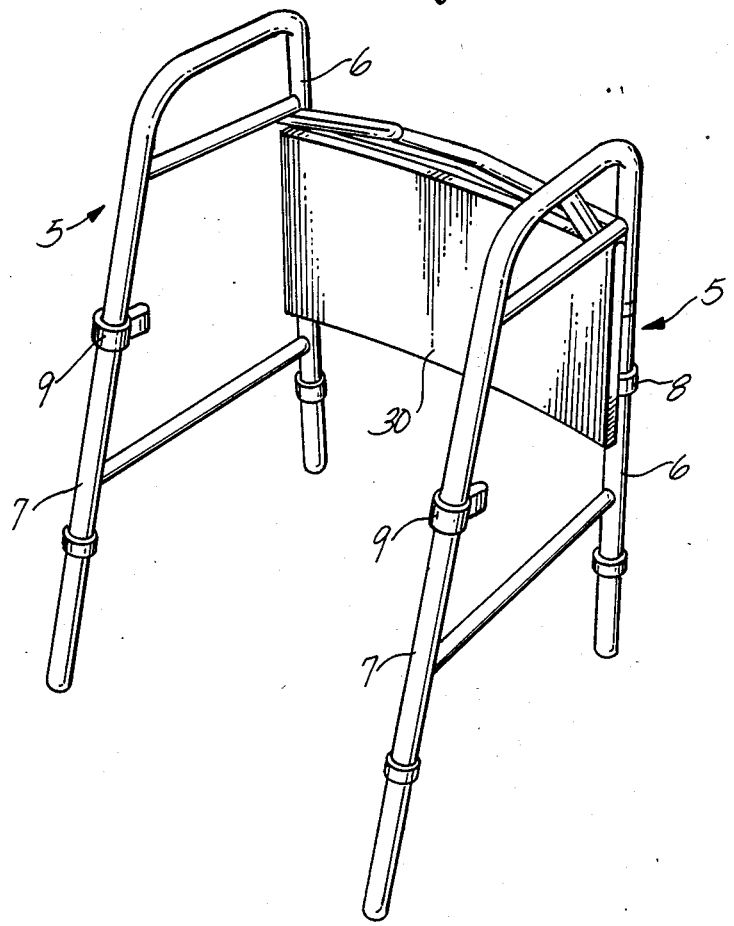
FIG 1B is a perspective view of the walker of FIG. 1A with the seat in the vertical stowed position.
Figure 1C:
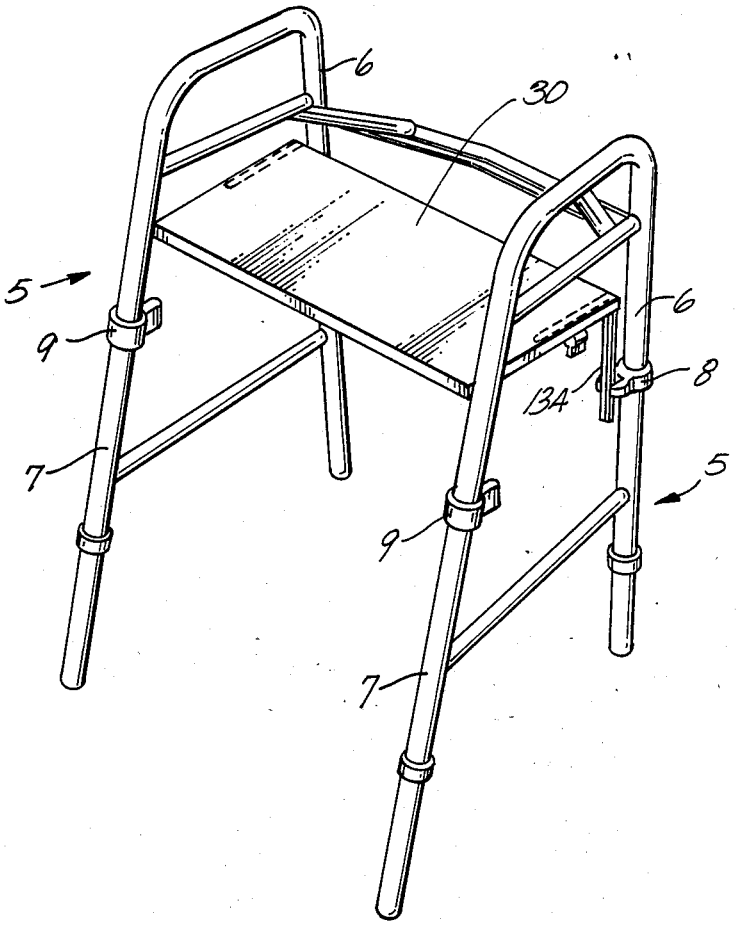
FIG. 1C is a perspective view of the walker of FIGS. 1A and 1B with the seat in a position intermediate the deployed and stowed position.

A walker with built-in seat according to the present invention is shown in FIGS. 1A, 1B and 1C illustrating the walker with seat deployed, seat stowed and seat intermediate the deployed and stowed positions. As shown therein, walker 1 is fitted with a rigid seat 30. The walker 1 has a tubular framework including two side frames 5. Side frames 5 include two outwardly canted front legs 6 and two outwardly canted rear legs 7. Each front leg 6 has a front clamp assembly 8 mounted thereon and rear legs 7 likewise have a rear leg clamp assembly 9 mounted thereon at the desired seat height. As shown, seat 30 is deployed to the seating position in FIG. 1A and rests on tabs or extensions integrally formed into clamp assemblies 8, 9. The front legs 6 are also connected to seat 30 by means of a pair of guides 134 which allows the seat to be stowed and deployed as discussed in greater detail below. The position of each clamp assembly 8, 9 is located to coincide with the strongest part of each side frame. Thus, seat 30 is secured by a clamp arrangement and the walker with built-in seat according to the present invention is designed for long-term durability with the clamps at this location.

Figure 2:
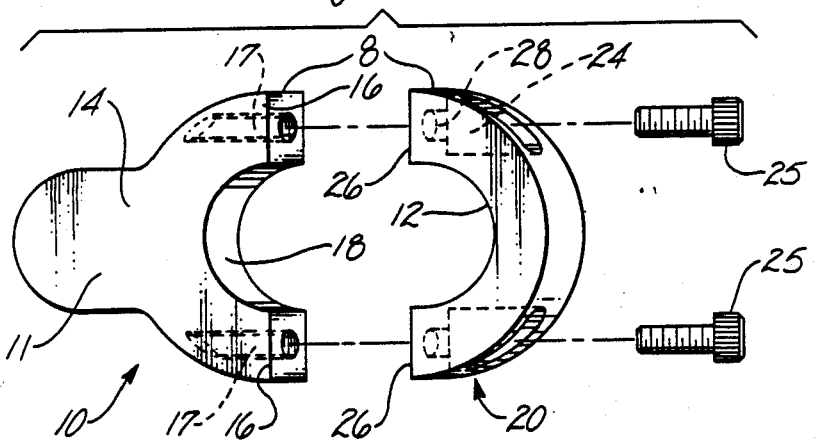
FIG. 2 is an exploded view of one embodiment of a rear leg clamp for supporting a rigid seat.
Figure 3:
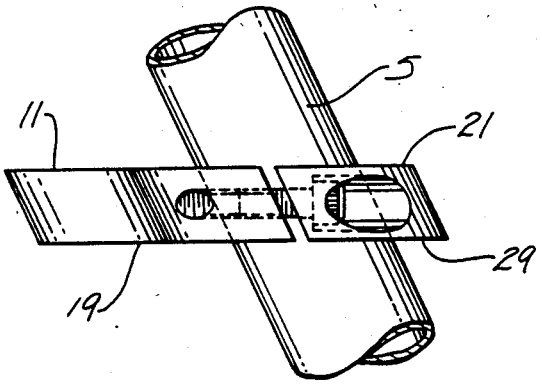
FIG. 3 is a side elevation view of the clamp in FIG. 2 shown mounted on a frame member of a walker.

A rear leg clamp assembly 9 is shown in greater detail in FIGS. 2 and 3. The clamp has a front section 10 with a top surface 11 and a bottom surface 19, and a rear clamp section 20 having a top surface 21 and a bottom surface 29. The two sections 10, 20 are held together with fasteners 25. In the preferred embodiment, the fasteners are socket-head cap screws 25, which can be turned with an Allen wrench.

The front section of the clamp 10 has a tab 14 of a predetermined outline inteqrally formed with a pair of arms 16. A concave inner face 18 is formed by the conjunction of the arms 16. The inner face 18 intersects the top surface 11 and the bottom surface 19 of the front section 10 so that an inclined angle is formed with each surface. Each arm 16 has a tapped hole 17 bored therein, parallel to the top and bottom surfaces 11 and 19, respectively, for receiving the fasteners 25.

The rear section of the clamp 20 is essentially semicircular in shape and has a pair of integral arms 26 which form a concave inner face 12. The inner face 12 intersects the top surface 21 and the bottom surface 29 of the rear section of the clamp 20 so that an inclined angle is formed with each surface. Each arm 26 has bored therein a counter bore 24 and a clearance hole 28, which coincide with the tapped holes 17 in the front section of the clamp 10 as indicated in the drawings.

FIG. 3 illustrates the manner in which a clamp assembly 9 engages a leg 7 of a walker with canted legs. First the front section of the clamp 10 is placed on one side of a frame element 5, so that the angular inner face 18 abuts the canted frame 5. Second, the rear section 20 is placed opposite the front section 10, so that the angular inner face 22 of the rear section 20 also abuts frame 5. Frame element 5 is thus circumscribed by the clamp 8. A minimal gap between the arms of the two clamp sections accommodates variable tolerances of the frame and clamps, and the two part clamp 8 is securely mounted on frame 5 by two fasteners 25. Each fastener 25 extends through the counter bore 24 and clearance hole 28 of an arm 26 of the rear section 20, to engage a tapped hole 17 of an arm 16 of the front section 10.

Figure 4:
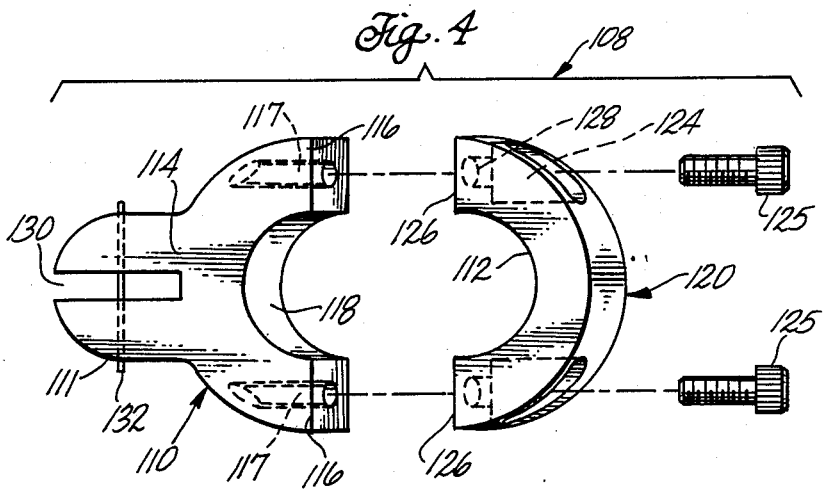
FIG. 4 is an exploded view of one embodiment of a front leg clamp for supporting a rigid seat.

FIG. 4 shows a front leg clamp assembly 108 for a walker with canted legs. Similar to the rear leg clamp assembly 9, the front leg clamp assembly has a rear section 110 with integral arms 116 and a tab 114 projecting in a direction opposite to the arms. The clamp assembly 108 also has a front section 120 with arms 126 adapted to fit around front leg 6 of the walker. Inner faces 112, 118 of the clamp 108 contact the walker front legs 6 when fasteners 125 are screwed into tapped bores 117 through countersunk 124 bores 126 in the rear clamp section 120.

Figure 5:
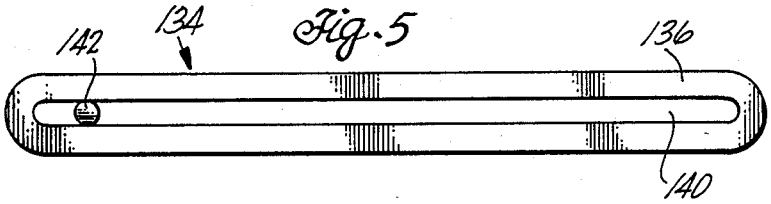
FIG. 5 is a side elevation view of a slotted guide bracket which interconnects the front portion of the walker and the front portion of the seat.

The front leg clamp assembly 108 differs from the rear leg clamp assembly 9 in that it also has a slot 130 cut into the end of the tab 114 extending towards the front section 120. In addition, a pin 132 extending through the tab 114 and the slot 130 perpendicular to the slot 130 has been added. As explained below the pin 132 and slot 130 are adapted to connect to a guide 134, shown in FIG. 5. The guide 134 has an elongated, rigid body 136 which defines a slot 140 extending substantially the length of the guide 134. The slot 140 is arranged to receive a pin 142 which is attached to the underside of the seat.

Figure 6:
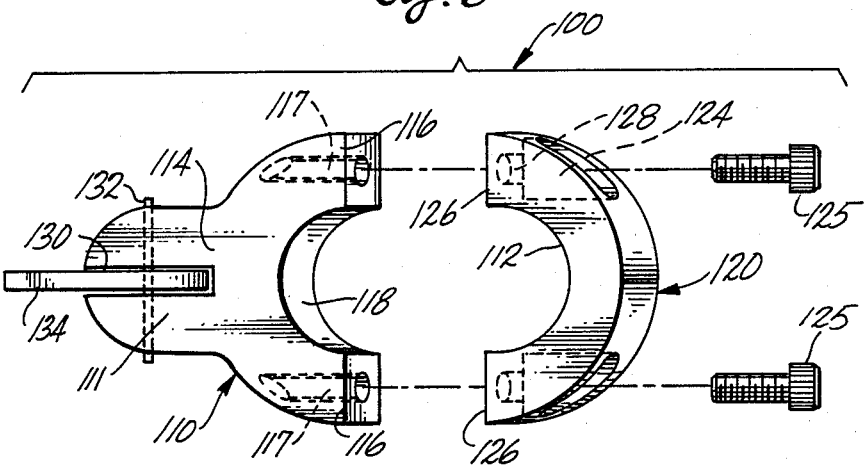
FIG. 6 is an exploded view of the clamp of FIG. 4 including a fragmentary view of the guide bracket.

FIG. 6 shows a front leg clamp assembly identical to that of FIG. 4 except that a slotted guide element 134 has been inserted into slot 130 in the rear clamp section 110 and a pin 132 extends through a slot 140 in guide element 134 to act as a retainer for guide 134. Pins 142 may be made removable so that the seat may be detached from the guides 134 to permit attachment and removal of the slot from the walker. Pins 132 may also be configured so as to be removable to permit removal of the seat.

Figure 7:
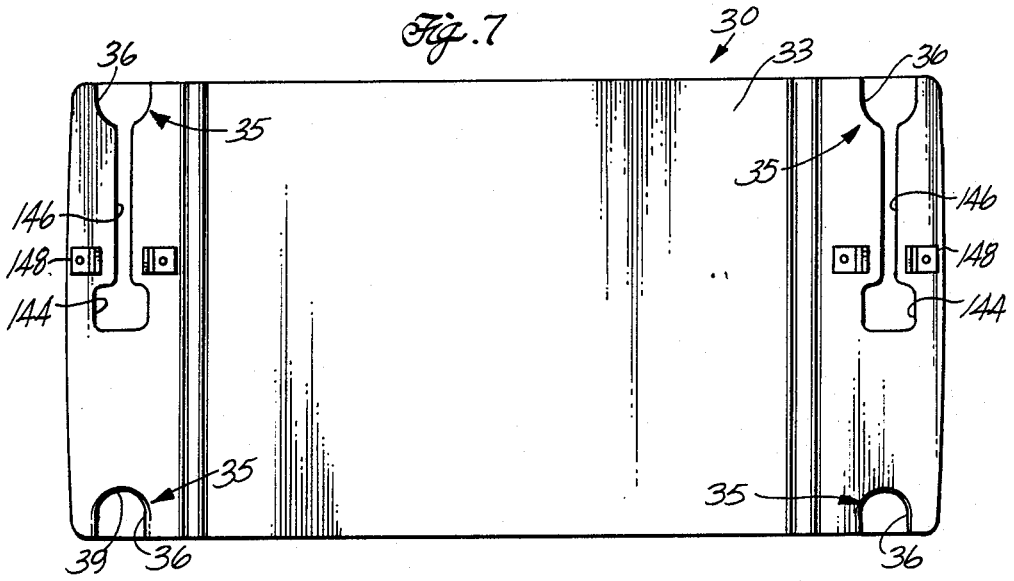
FIG. 7 is a bottom view of a rigid seat according to the present invention.
Figure 8:
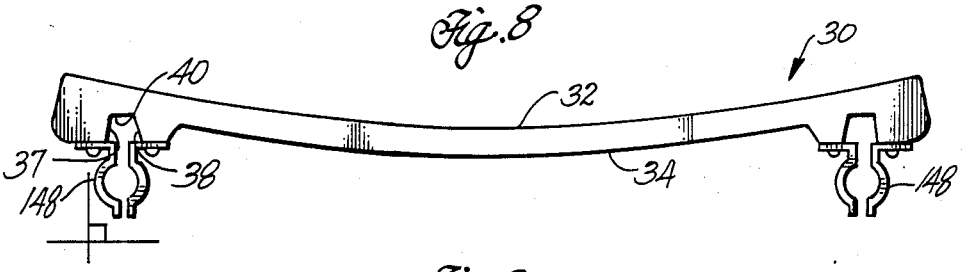
FIG. 8 is a side view of the seat in FIG. 7.

FIGS. 7 and 8 show a preferred embodiment of movable seat 30. The generally rectangular seat 30 has a slightly concave top surface 32 and a slightly convex bottom surface 34. Preferably, the seat is formed of a generally rigid material such as molded plastic or wood. It will be appreciated that the top surface 32 could be padded, and otherwise ergonomically designed.

The bottom surface 34 of seat 30 comprises a central area 33, and four receptacles 35 formed into the corners of the seat. Each receptacle 35 comprises a central area 36 open at one side, an outer vertical wall 37, an inner vertical wall 38, a concave inner surface 39 boarding area 36, and a generally flat upper surface 40. Each receptacle mates with the tabs 14 of a corresponding clamp assembly 8, 9.

More specifically, the receptacle 35 is defined and formed by the integral conjunction of the inner and outer walls 37, 38, surface 39 and surface 40. Preferably, the outer wall is half an inch thick, and half an inch deep. Surface 40 seats on and is generally parallel to, and abuts, the top surface 11 of tab 14 of the rear clamp section 10, when the seat 30 is secured to the walker. Since the walker frame elements 5 to which the clamps are attached are canted outwardly to give the walker greater stability, the legs are not perpendicular. This in turn, means that surfaces 11 and 40 are not parallel to the ground, but rather each defines an acute angle with respect to a plane parallel to the ground.

The outer and inner walls just described eliminate excessive side-to-side rocking of the seat about the clamps 8, 108. The inner walls 38 act as "stops" for the clamp extensions 14, and help lock the seat 30 in position. Similarly, the inner surface 39 of each receptacle 35 prevents back and forth seat movement. Both advantages are realized through the engagement of the tab 14 of each clamp with a corner receptacle 35.

As shown in FIG. 1, the four clamp assemblies 8, 9 are fastened to the canted side frame elements 5 of a walker 1. The rear clamp section 10 of each clamp assembly 9 protrudes into the space enclosed by the walker 1. Seat 30 seats upon the tab 14 of each front clamp section 10, and tabs 14 snugly engage the corner receptacles 35 of the seat. Thus, side-to-side and back and forth sliding and rocking of the seat is avoided, and the seat 30 is firmly and positively retained in place on the walker.

Figure 10:
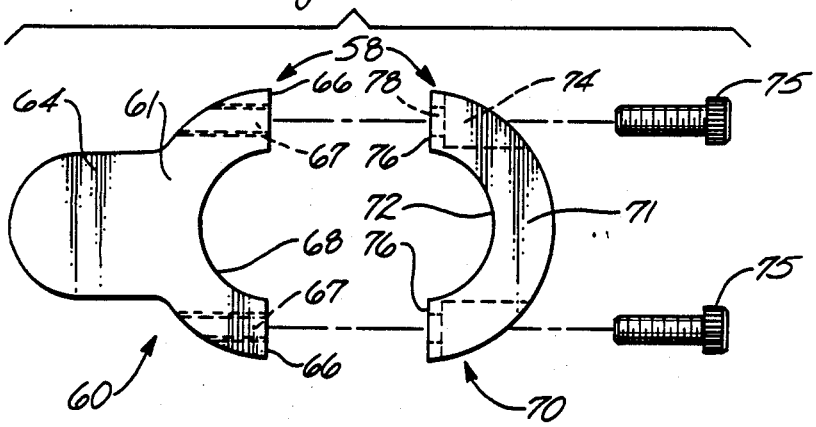
FIG. 10 is an exploded view of an alternate embodiment of a support clamp according to the present invention for use with vertical frame elements.

FIG. 7 also shows a center receptacle 144 on either side of the seat approximately halfway between the corner receptacles 35. Two of the corner receptacles 35 and the corresponding center receptacle 144 are joined by a narrow groove 146. The center receptacles 144 are large enough to receive the tabs 114 of the front leg clamps 108 when the seat 30 is folded against the front legs 6 as shown in FIG. 10. The depth of the center receptacles 144 may be varied to suit different clamp types and different walkers. The grooves 146 are large enough to receive the guides 134 when the seat 30 is folded as in FIG. 10.

The seat 30 also has a retainer 148 fastened to either side of the seat 30. The retainers 148 are preferably clips, see e.g. FIG. 8, which engage the front legs 6 of the walker 1 when the seat is folded. However, other retainers for holding the seat in the folded position of FIG. 10 may be used instead.

Figure 9A:
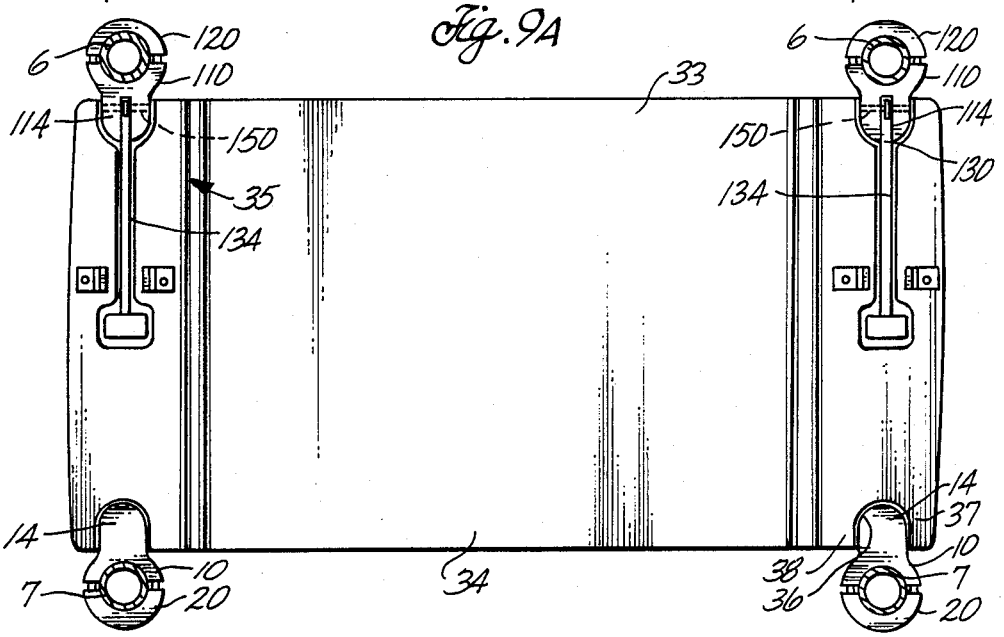
FIG. 9A is a bottom plan view showing the seat of the present invention in the deployed position in engagement with four support clamps.

FIG. 9A shows a pin 150 extending through the corner receptacles 35 corresponding to the front leg clamps 108. The pins are adapted to retain guide 134 and, like pins 142 in the front clamps 108, may be made removable so that the seat 30 may be removed from the walker.

FIG. 9A shows the seat 30 of FIG. 7 as viewed from the bottom when supported by the clamp assembly 8, 108 shown in FIGS. 2 and 4. As shown in FIG. 9, each tab 114, engages the corresponding receptacle 35 to firmly hold the seat in place. The guides 134 installed in the slots 146 in the front leg clamps 108 hang vertically downward (see also FIG. 1).

Figure 9B:
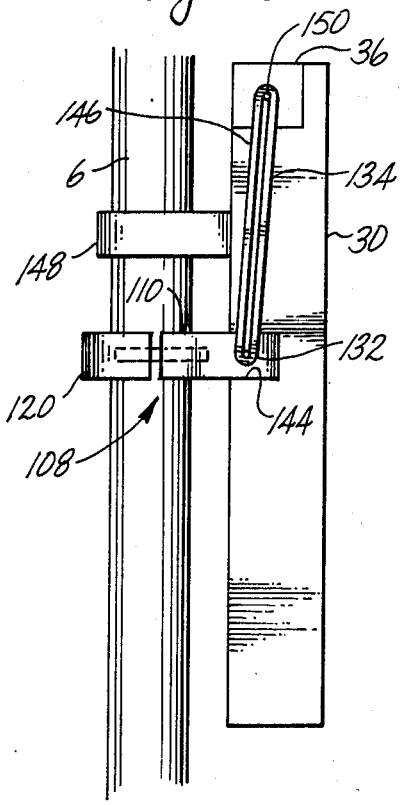
FIG. 9B is a fragmentary view showing the seat of the present invention in the stowed vertical position adjacent the front portion of the walker.

From the position shown in FIG. 9A, the seat 30 may be lifted and folded into the position of FIG. 9B. FIG. 9B shows the seat 30 positioned parallel to front leg 6. The front leg clamp assembly 108 extends into the center receptacle 144 and supports the seat 30. The retainer 148 is clipped around the front leg 6. The guide 134 is retained by a pin 142 on the front clamp assembly 108 and a corresponding pin 150 on the seat 30. In this position the guide 134 is contained entirely within the groove 146 between the center and corner receptacles 144, 35. The seat 30 is held securely by the retainers 148 and folded away from the rear legs 7. This provides plenty of room for the user to stand between the front and rear legs 6,7 of the walker when the walker is in use.

The seat 30 is moved from the deployed to the stowed position by first lifting the seat up and away from the supporting tabs 14, 114. Next, the front edge of seat 30 is drawn upwards and the rear edge dropped while the seat is pivoted forward until the center receptacles 144 may be placed over the front leg clamp assembly 108. At this point the rear receptacles 35 are adjacent the front legs 6 as gravity induces the seat 30 to hang vertically and the retainers 148 are pushed against the front legs 6 until they snap into place. To move the seat to the unfolded position the process is reversed.

The guides 146 assist by limiting the movement of the seat 30. While it is presently preferred that slotted rods connecting the seat to the front leg clamps be used, other guide arrangements are possible and the guide need not necessarily be fastened to the clamp. In addition, the present invention provides for the seat to fold forward, against the front legs 6 of the walker 1 to provide clearance between the legs 5 for the user to stand in. The seat may also be provided so that it folds to the side or back if desired for other applications.

It will be appreciated by those skilled in the art that the clamp and seat assembly described above can be adapted for use with all types of walkers. Thus, walkers having a framework different from that described above can be retrofitted with the present invention.

Figure 11:
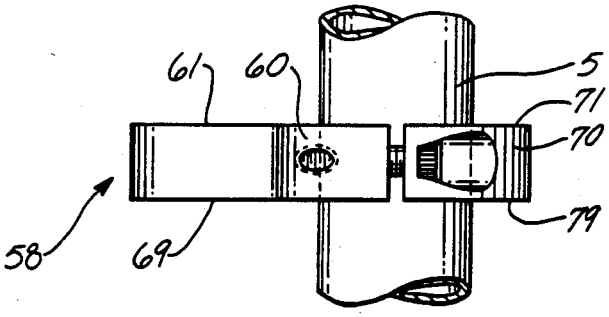
FIG. 11 is a side view of the clamp in FIG. 10.
Figure 12:
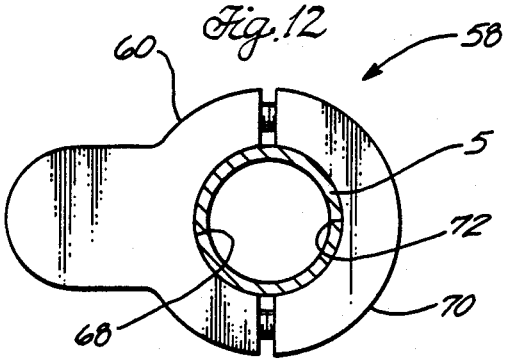
FIG. 12 is a bottom view of the clamp shown in FIGS. 10 and 11.

FIGS. 10–12 show an alternate embodiment of a clamp designed to engage frame elements of a walker in which the legs are vertical rather than canted. Specifically, clamp 58 comprises a front clamp section 60 and a rear clamp section 70, that are joined together with a pair of fasteners 75. Both the front clamp section 60 and the rear clamp section 70 have top surfaces, 61 and 71 respectively, and bottom surfaces, 69 and 79 respectively, as shown in FIG. 11.

The front clamp section 60 has a tab 64 of a predetermined outline integrally formed with a pair of arms 66. A concave inner face 68 is formed by the conjunction of the arms 66. The inner face 68 intersects the top surface 61 and the bottom surface 69 of the front clamp section 60 at a ninety degree angle. Each arm 66 has a tapped hole 67 bored therein, parallel to the top and bottom surfaces 61 and 69, respectively, for receiving a fastener 75.

The rear clamp section 70 is essentially semicircular in shape and comprises a pair of arms 76 integrated together to form a concave inner face 72. The inner face 72 intersects the top surface 71 and the bottom surface 79 of the rear clamp section 70 at a ninety degree angle. Each arm 76 has a counter bore 74 and a clearance hole 78 bored into it. The clamp 58 may be adapted for use as a front leg clamp by cutting a slit and inserting a pin similar to that shown in FIGS. 4–6.

Clamp 58 engages a vertical side frame element 5 of a walker in the manner depicted in FIGS. 11 and 12. First, the front section 60 is placed on one side of a frame element 5, so that the inner face 68 abuts the frame 5. Second, the rear section 70 is placed on the other side of the frame 5, opposite the front clamp section 60. The two pairs of arms, 66 and 76, circumscribe the frame 5. Fasteners 75 secure the two clamp sections together in a manner similar to that described above.

Walkers of various sorts can be retrofitted with a removable seat, as described above. Thus, walkers having both vertical and angular side frame elements can be retrofitted by using clamps of both of the aforementioned types.

In yet another alternate embodiment of the invention, the seat and clamps are constructed with a pin and aperture arrangement that imparts additional stability to the walker-seat assembly.

Figure 13:
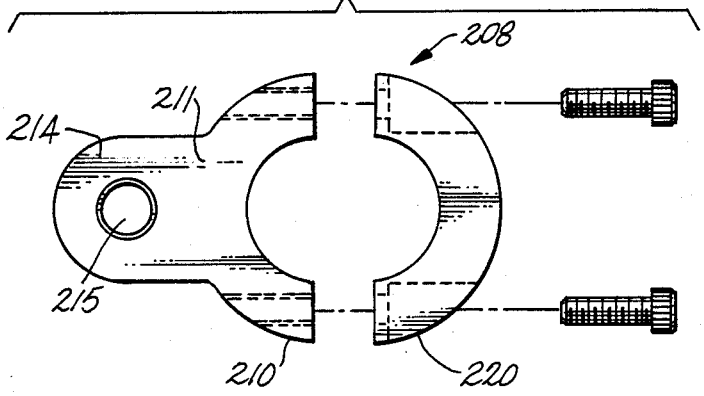
FIG. 13 is an exploded view of another alternate embodiment of a support clamp.
Figure 14:
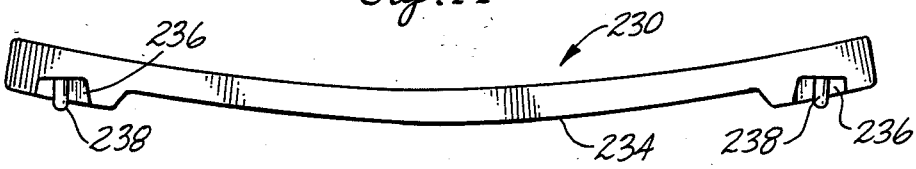
FIG. 14 is a side view of another alternate embodiment of a rigid seat for use with the clamp of FIG. 13.

More specifically, FIG. 13 shows an alternate clamp 208, with front and rear clamp sections 210, 220. Alternate clamp 208 is similar to the clamps described above, but the front section 210 has an aperture 215 bored through tab 214, from the top surface 211 to the bottom surface 219 of the clamp 208. As shown in FIG. 14, seat 230 adapted to fit on the alternate clamp 208, is similar to seat 30, described above, except that a pin 238 extends outwardly in a downward direction from each receptacle 236 in the bottom surface 234 of the seat.

Thus, seat 230 sits on the top surface 211 of each clamp 208, so that the tab 214 of each first clamp element 210 fits into a receptacle 236 of the seat. Each pin 238 fits snugly into the aperture 215 of a tab 214. As with the alternate embodiment of FIGS. 10–12 the aperture clamp 208 is shown as a rear leg clamp. It may be adapted for use as a front leg clamp by providing a slit and a pin similar to that shown in FIGS. 4–6.

Figure 15:
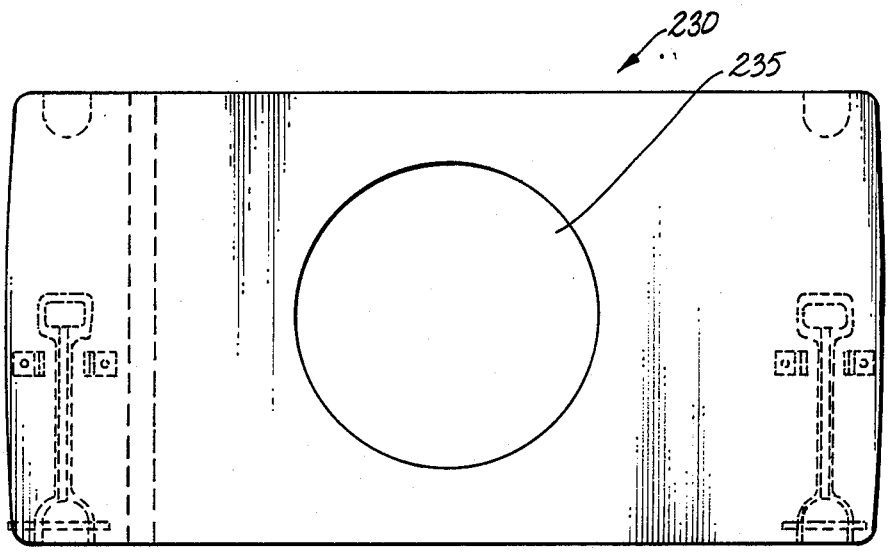
FIG. 15 is a plan view of another embodiment of a rigid seat for use when the walker is converted into use as a commode seat.

In still another embodiment of the present invention, shown in FIG. 15, the removable seat is configured as a commode seat 330 for use with a toilet. This seat is similar to the seats described above, such as seat 30 except that an opening 335 is centrally located in the seat. The opening 335 is preferably about eight inches in diameter, and is centrally positioned with respect to the outer edges of the seat.

When the commode seat 330 is to be used, the walker is rolled or placed in position over a toilet, and the seat 330 is unfolded in the manner described above. After use, the seat is readily folded against the front frame legs in the same way as the seat 30 described above by removing the pins 350 which hold the seat 330 to the guides 134. The commode seat may be replaced with a conventional seat 30 and vice versa.

The above described walker and seats exemplify presently preferred embodiments of the invention; other arrangements may be foreseeable to those skilled in the art, without departing from the spirit and scope of the invention.

What is claimed is:

1. A walker with a foldable seat comprising:

at least one front leg;

a plurality of rear legs;

a plurality of clamps, each clamp connected to one of the plurality of legs and each clamp having a tab;

a seat having a plurality of receptacles located at spaced intervals on the underside of the seat, each receptacle corresponding to and adapted to engage one of the tabs for supporting the seat;

at least one elongated arm pivotally engaged with and extending between a first pivot point located at a seat receptacle adjacent the front edge of the seat and a second pivot point located on a corresponding front leg clamp so that the seat may be moved from an in-use position supported by the tabs to a storage position against the front legs.

2. The walker of claim 1 also comprising a pin connected to each front leg at said first pivot point and a corresponding pin connected to the seat for each front leg pin at said second pivot point and wherein the arm comprises a rod defining an elongated slot for each front leg pin, said slot engaging a front leg pin and the corresponding seat pin.

3. The walker of claim 2 wherein each front leg pin is connected to a front leg clamp.

4. The walker of claim 2 also comprising an additional recess within the seat for each rod, each additional recess being positioned to receive the corresponding rod when the seat is in the storage position.

5. The walker of claim 1 wherein each receptacle comprises a recess in the seat into which the corresponding tab fits.

6. The walker of claim 1 also comprising a second recess within the seat for each front leg clamp, each second recess being positioned to receive at least a portion of the corresponding front leg clamp when the seat is in the storage position.

7. The walker of claim 1 also comprising a retainer for holding the seat in the storage position.

8. The walker of claim 7 wherein the retainer comprises a clip fastened to the seat for engaging a front leg and holding the seat against the corresponding front leg.

9. The walker of claim 1 wherein the seat is rigid.

10. The walker of claim 1 wherein the seat includes a central opening for use with a commode.

11. A foldable seat for use with a walker having at least one front leg and a plurality of rear legs, the foldable seat comprising:

a plurality of clamps adapted to connect to a plurality of the legs, each clamp having a tab;

a seat having a plurality of receptacles located at spaced intervals on the underside of the seat, each receptacle corresponding to and adapted to engage one of the tabs for supporting the seat;

at least one elongated arm pivotally engaged with and extending between a first pivot point located at a seat receptacle adjacent the front edge of the seat and a second pivot point located on a corresponding front leg clamp so that the seat may be moved from an in-use position supported by the tabs to a storage position against the front legs.

12. The foldable seat of claim 11 also comprising a pin connected to each front leg at said first pivot point and a corresponding pin connected to the seat for each front leg pin at said second pivot point and wherein the arm comprises a rod defining an elongated slot for each front leg pin said slot engaging a front leg pin and the corresponding seat pin.

13. The foldable seat of claim 12 wherein each front leg pin is connected to a front leg clamp.

14. The foldable seat of claim 12 also comprising an additional recess within the seat for each rod, each additional recess being positioned to receive the corresponding rod when the seat is in the storage position.

15. The foldable seat of claim 11 wherein each receptacle comprises a recess in the seat into which the corresponding tab fits.

16. The foldable seat of claim 11 also comprising a second recess within the seat for each front leg clamp, each second recess being positioned to receive at least a portion of the corresponding front leg clamp when the seat is in the storage position.

17. The foldable seat of claim 11 also comprising a retainer for holding the seat in the storage position.

18. The foldable seat of claim 17 wherein the retainer comprises a clip fastened to the seat for engaging a front leg and holding the seat against the corresponding front leg.

19. The foldable seat of claim 11 wherein the seat is rigid.

20. The foldable seat of claim 11 wherein the seat includes a central opening for use with a commode.

21. A kit for retrofitting a walker with a foldable seat, having component parts capable of being attached to a walker, the kit comprising the combination of:

a seat for supporting a person; said seat having a plurality of receptacles located at spaced intervals on the underside of the seat, a plurality of clamps for supporting the seat, each clamp adapted to connect to a part of the walker and engage a corresponding receptacle on the seat;

at least one elongated arm adopted to pivotally engage and extend between a first pivot point located at a receptacle adjacent the front edge of the seat and a second pivot point located on a corresponding front clamp to permit the seat to be moved from an in-use position supported by the clamps to a storage position folded against a part of the walker.

22. The kit of claim 21 wherein each clamp comprises a tab and the seat comprises a plurality of receptacles adapted to engage the tabs for supporting the seat, each receptacle corresponding to a tab.

23. The kit of claim 22 wherein each receptacle comprises a recess in the seat into which the corresponding tab fits.

24. The kit of claim 21 also comprising a pin adapted to connect to a part of the walker at said first pivot point and a corresponding pin connected to the seat for each walker pin at said second pivot point and wherein the arm comprises a rod defining an elongated slot for each walker pin, said slot engaging a walker pin and a corresponding seat pin.

25. A kit of claim 23 wherein each walker pin is connected to a clamp.

26. The kit of claim 24 also comprising an additional recess within the seat for each rod, each additional recess being positioned to receive the corresponding rod when the seat is in the storage position.

27. The kit of claim 21 also comprising a second recess within the seat for each clamp against which the seat may be folded, each second recess being positioned to receive at least a portion of the corresponding clamp when the seat is in the storage position.

28. The kit of claim 21 also comprising a retainer for holding the seat in the storage position.

29. The kit of claim 28 wherein the retainer comprises a clip fastened to the seat for engaging a front leg and holding the seat against the corresponding front leg.

30. The kit of claim 21 wherein the seat is rigid.

31. The kit of claim 21 wherein the seat includes a central opening for use with a commode.

* * * * *